US010504407B2

(12) United States Patent
Jang et al.

(10) Patent No.: US 10,504,407 B2
(45) Date of Patent: Dec. 10, 2019

(54) DISPLAY PANEL WITH SLIM BORDER AND METHOD OF DRIVING DISPLAY PANEL

(71) Applicant: AU Optronics Corp., Hsin-Chu (TW)

(72) Inventors: Shuo-Wen Jang, Hsin-Chu (TW); Jui-Chi Lo, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 119 days.

(21) Appl. No.: 15/232,790

(22) Filed: Aug. 9, 2016

(65) Prior Publication Data

US 2017/0061933 A1 Mar. 2, 2017

(30) Foreign Application Priority Data

Aug. 28, 2015 (CN) ..... 2015 1 0539638

(51) Int. Cl.
*G09G 3/20* (2006.01)

(52) U.S. Cl.
CPC ..... *G09G 3/2085* (2013.01); *G09G 2310/08* (2013.01)

(58) Field of Classification Search
CPC ... G09G 2300/0426; G09G 2310/0205; G09G 2310/0221; G09G 2310/0251; G09G 2310/0297; G09G 2310/08; G09G 3/2085
See application file for complete search history.

(56) References Cited

U.S. PATENT DOCUMENTS

2005/0117611 A1* 6/2005 Shin ..... G09G 3/325 370/536
2006/0077191 A1* 4/2006 Ming-Daw ..... G02F 1/133351 345/204
2008/0043012 A1* 2/2008 Shirai ..... G09G 3/2011 345/215
2008/0266210 A1* 10/2008 Nonaka ..... G09G 3/20 345/55
2009/0207104 A1* 8/2009 Lee ..... G09G 3/3275 345/76
2009/0251455 A1* 10/2009 Park ..... G09G 3/2007 345/214
2009/0273388 A1* 11/2009 Yamashita ..... G09G 3/3648 327/416
2009/0289878 A1* 11/2009 Chen ..... G09G 3/3688 345/87

(Continued)

FOREIGN PATENT DOCUMENTS

CN 101149895 A 3/2008
CN 101295081 A 10/2008

(Continued)

*Primary Examiner* — Kenneth Bukowski
(74) *Attorney, Agent, or Firm* — WPAT, PC

(57) ABSTRACT

A display panel includes a pixel block, a data circuit, and a data source. The pixel block includes a first sub-pixel coupled to a first data line, and N second sub-pixels. Each second sub-pixel of the N second sub-pixels is coupled to a corresponding second data line of N second data lines. The data circuit includes N switches. Each switch of the N switches is coupled to a corresponding second sub-pixel. When N voltage levels are sequentially outputted from the data source to the first data line and the N second data lines, the N switches are disabled sequentially.

19 Claims, 5 Drawing Sheets

(56) References Cited

U.S. PATENT DOCUMENTS

| | | | | |
|---|---|---|---|---|
| 2010/0117939 | A1* | 5/2010 | Lee | G09G 3/3275 345/76 |
| 2010/0134743 | A1* | 6/2010 | Shin | G02F 1/13 349/143 |
| 2014/0253419 | A1* | 9/2014 | Tanada | G09G 3/2092 345/55 |
| 2014/0307004 | A1* | 10/2014 | Roh | G09G 3/3208 345/690 |
| 2016/0225306 | A1* | 8/2016 | Shin | G09G 3/2092 |

FOREIGN PATENT DOCUMENTS

| | | | |
|---|---|---|---|
| CN | 104464603 | A | 3/2015 |
| TW | 200939186 | A | 9/2009 |
| TW | 200949810 | A | 12/2009 |

* cited by examiner

DISPLAY PANEL WITH SLIM BORDER AND METHOD OF DRIVING DISPLAY PANEL

BACKGROUND OF THE INVENTION

1. Field of the Invention

The present invention generally illustrates a display panel, and more particularly, a display panel with slim border.

2. Description of the Prior Art

With the advancement of techniques, various monitors and display panels are adopted in our daily life. The display panel can be applied to a smart phone, a tablet, a laptop computer, or a personal computer. Specifically, the display panel embedded on the device is required to satisfy requirements of being slim, light, low power consumption, and high display quality. Since the display panel with a maximum pixel capacity can perform satisfactory display quality, display developers and manufacturers make effort to improve pixel density of display panel in conjunction with a slim border for increasing display quality and market competitiveness.

Conventionally, several non-rectangular shaped display panels are also applied to electronic devices. For example, a display panel of a smart watch (i.e., an Apple® i-watch) and some measurement panels of sensors are manufactured with arc-shaped or rounded corners. In general, the display panel includes a data source for generating data signal. The data signal is transmitted to each pixel block of the display through a fan-out circuit. Particularly, in a non-rectangular shaped display panel, data circuits are respectively coupled to corresponding pixel blocks according to predetermined allocations.

Although conventional display panels use different allocation methods for reducing the layout area requirement of the display panel, additional layout area of display panel are still required. Thus, the width of border cannot be optimized.

SUMMARY OF THE INVENTION

In an embodiment of the present invention, the display panel is disclosed. The display panel includes a pixel block, a data circuit, and a data source. The pixel block includes a first sub-pixel coupled to a first data line, and N second sub-pixels. Each second sub-pixel of the N second sub-pixels is coupled to a corresponding second data line of N second data lines. The data circuit includes N switches. Each switch of the N switches is coupled to a corresponding second sub-pixel. The data source is coupled to the first data line and the N second data lines. When N voltage levels are sequentially outputted from the data source to the first data line and the N second data lines, the N switches are disabled sequentially so that when a corresponding voltage level is written to the first sub-pixel, the corresponding voltage level is written to at least one second sub-pixel of the N second sub-pixels, and N is a positive integer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
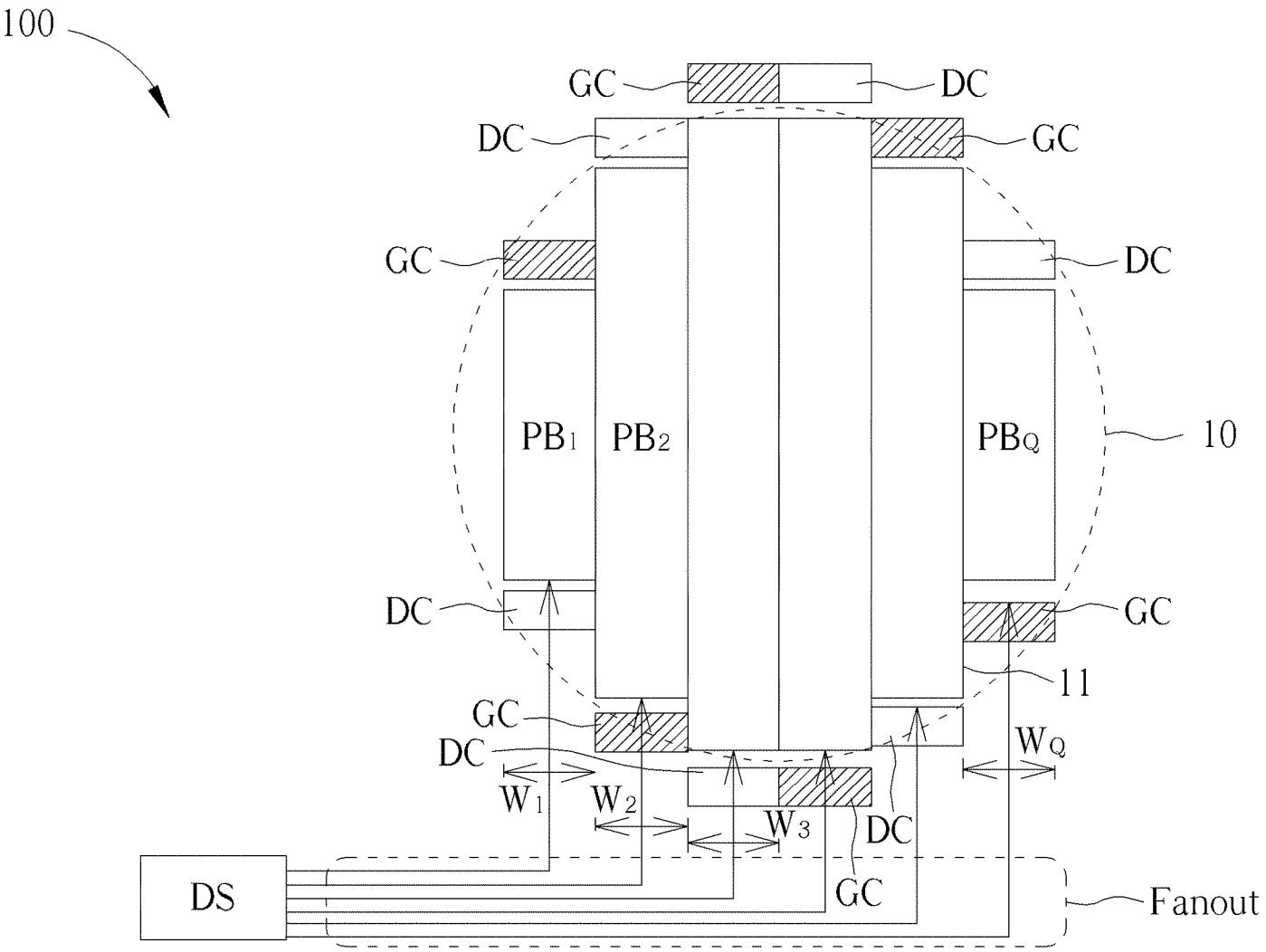
FIG. 1 illustrates a structure of a display panel according to a first embodiment of the present invention.

FIG. 1 illustrates a structure of a display panel 100 according to a first embodiment of the present invention. As shown in FIG. 1, the display panel 100 is a circular display panel. The display panel 100 includes a circular display area 10. The display area 10 includes a plurality of rectangular shaped pixel blocks $PB_1$ to $PB_Q$. Q is a positive integer. The plurality of pixel blocks $PB_1$ to $PB_Q$ forms a pixel region 11. The pixel blocks $PB_1$ to $PB_Q$ include a plurality of sub-pixels. The display panel 100 further includes a plurality of data circuits DC. These data circuits DC are respectively coupled to the pixel blocks $PB_1$ to $PB_Q$ and disposed to the upside and downside of pixel blocks $PB_1$ to $PB_Q$ alternately. As illustrated in FIG. 1, the pixel block $PB_1$ is coupled to a corresponding data circuit DC. The corresponding data circuit DC is disposed to the downside of the pixel block $PB_1$. The pixel block $PB_2$ is coupled to a corresponding data circuit DC. The corresponding data circuit DC is disposed to the upside of the pixel block $PB_2$, and so on. The display panel 100 further includes a plurality of gate circuits GC. These gate circuits GC are disposed to the upside and downside of the pixel blocks $PB_1$ to $PB_Q$ alternately. As illustrated in FIG. 1, the pixel block $PB_1$ has a corresponding gate circuit GC disposed to the upside. The pixel block $PB_2$ has a corresponding gate circuit GC disposed to the downside, and so on. A method for driving the pixel blocks $PB_1$ to $PB_Q$ by using the gate circuits GC is illustrated later (i.e., illustrated in FIG. 3). In other words, in the display panel 100, the gate circuit GC and the data circuit are disposed to two opposite sides of each pixel block $PB_1$ to $PB_Q$. In the embodiment, the display panel 100 further includes a data source DS and a fan-out circuit (labeled "Fanout"). Specifically, the data source DS can be any device having capability of generating image data or receiving image data. The data source DS can generate an appropriate data signals supported by the display panel 100. The data signals can be transmitted to each pixel block $PB_1$ to $PB_Q$ through the fan-out circuit. The layout of the fan-out circuit of the display panel 100 is not limited to the layout shown in FIG. 1. For example, the fan-out circuit can be allocated according to a structure in FIG. 2. Here, when the data circuits DC receive the data signals generated by the data source DS, sub-pixels of pixel blocks $PB_1$ to $PB_Q$ are driven for displaying image. In the display panel 100, $W_1$ denotes a width of a data circuit DC corresponding to the pixel block $PB_1$. $W_2$ denotes a width of a data circuit DC corresponding to the pixel block $PB_2$. And so on, $W_Q$ denotes a width of a data circuit DC corresponding to the pixel block $PB_Q$. Particularly, $W_1$ to $W_Q$ can be identical values. $W_1$ to $W_Q$ can also be different or partially identical values. Particularly, when Q becomes large, $W_1$ to $W_Q$ can be chosen as small values for increasing the sub-pixel density (or say, capacity) of the pixel blocks $PB_1$ to $PB_Q$ in the display region 10. By doing so, a shape of the pixel region 11 formed by the pixel blocks $PB_1$ to $PB_Q$ is consistent with a shape of display region 10. The method for driving sub-pixels of the pixel blocks $PB_1$ to $PB_Q$ by using the data signals generated by the data source DS through the data circuits DC is illustrated below.

Figure 2:
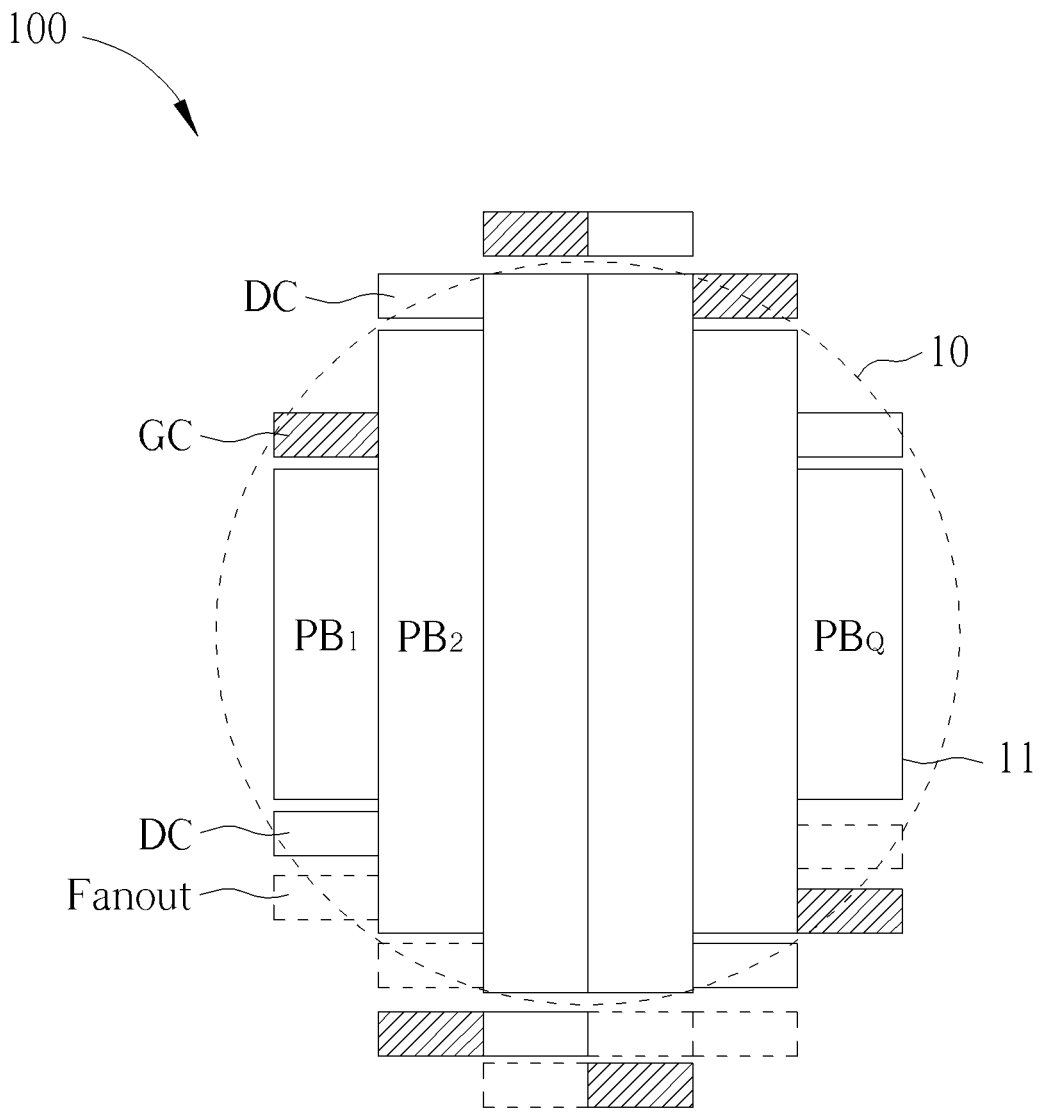
FIG. 2 illustrates allocations of fan-out circuits of the display panel in FIG. 1.

FIG. 2 illustrates allocations of fan-out circuits of the display panel 100. In FIG. 2, the fan-out circuits (i.e., dotted line with labeled 'Fanout') can be disposed to a side (downside) of the pixel blocks $PB_1$ to $PB_Q$. For the pixel blocks $PB_1$, a corresponding gate circuit GC is disposed to the upside of the pixel blocks $PB_1$. A corresponding data circuit DC is disposed to the downside of the pixel blocks $PB_1$. A corresponding fan-out circuit can be disposed to the downside of the corresponding data circuit DC. For the pixel blocks $PB_2$, a corresponding data circuit DC is disposed to the upside of the pixel blocks $PB_2$. A corresponding fan-out circuit can be disposed to the downside of the pixel blocks $PB_2$. A corresponding gate circuit GC can be disposed to the downside of the corresponding fan-out circuit. However, allocations of the fan-out circuits of the display panel 100 are not limited to the allocations illustrated in FIG. 2. In other embodiments, each fan-out circuit can be appropriately disposed to another place for reducing layout area required.

Figure 3:
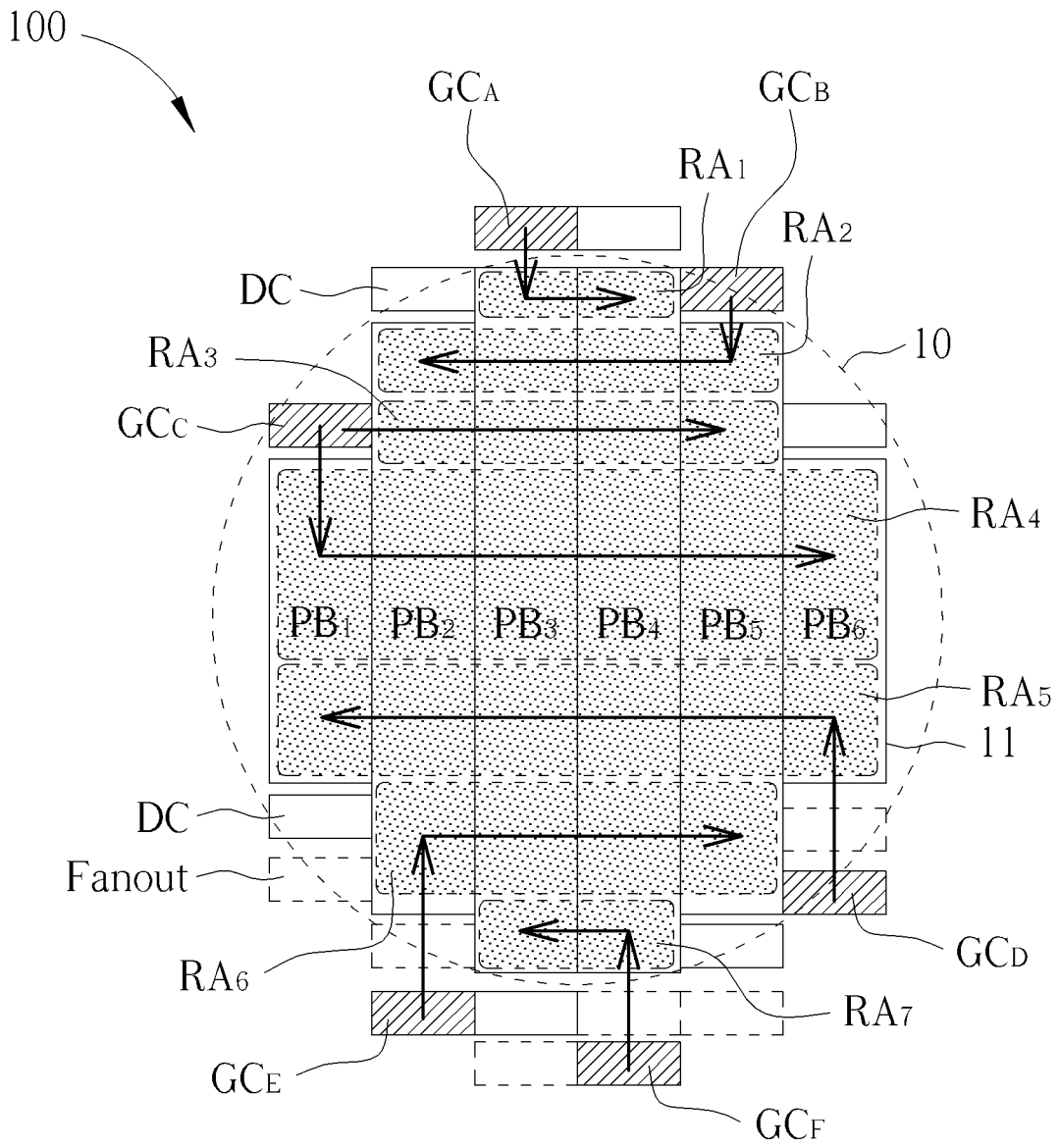
FIG. 3 illustrates a driving method of the display panel in FIG. 2 by using gate circuits.

FIG. 3 illustrates a driving method of the display panel 100. In FIG. 3, the pixel blocks $PB_1$ to $PB_Q$ are driven by the gate circuits GC. For simplicity, Q=6 is taken as an example. Here, the pixel blocks of the display panel 100 are labeled as the pixel block $PB_1$ to the pixel block $PB_6$. The gate circuits GC of the display panel 100 are labeled as a gate circuit $GC_A$, a gate circuit $GC_B$, a gate circuit $GC_C$, agate circuit $GC_B$, agate circuit $GC_E$, and a gate circuit $GC_F$. Further, dotted areas $RA_1$ to $RA_6$ denote as a region (area) of sub-pixels of the display panel 100 (i.e., hereafter 'sub-pixel region $RA_1$ to sub-pixel region $RA_6$'). As shown in FIG. 3, the gate circuit $GC_A$ generates driving currents. The driving currents are transmitted to the sub-pixel region $RA_1$ along a direction of the arrow. Then, the sub-pixel region $RA_1$ can be driven by the driving currents. Specifically, the sub-pixel region $RA_1$ includes partial sub-pixels of the pixel block $PB_3$ and the pixel block $PB_4$. The gate circuit $GC_B$ generates driving currents. The driving currents are transmitted to the sub-pixel region $RA_2$ along a direction of the arrow. Then, the sub-pixel region $RA_2$ can be driven by the driving currents. Specifically, the sub-pixel region $RA_2$ includes partial sub-pixels of the pixel block $PB_2$ to the pixel block $PB_5$. The gate circuit $GC_C$ generates driving currents. The driving currents are transmitted to the sub-pixel region $RA_3$ along a direction of the arrow. Then, the sub-pixel region $RA_3$ can be driven by the driving currents. Specifically, the sub-pixel region RA3 includes partial sub-pixels of the pixel block PB2 to the pixel block PB5. The gate circuit $GC_C$ also generates another driving currents. The driving currents are transmitted to the sub-pixel region $RA_4$ along another direction of the arrow. Then, the sub-pixel region $RA_4$ can be driven by the driving currents. Specifically, the sub-pixel region $RA_4$ includes partial sub-pixels of the pixel block $PB_1$ to the pixel block $PB_6$. The gate circuit $GC_D$ generates driving currents. The driving currents are transmitted to the sub-pixel region $RA_5$ along a direction of the arrow. Then, the sub-pixel region $RA_5$ can be driven by the driving currents. Specifically, the sub-pixel region $RA_5$ includes partial sub-pixels of the pixel block $PB_1$ to the pixel block $PB_6$. The gate circuit $GC_E$ generates driving currents. The driving currents are transmitted to the sub-pixel region $RA_6$ along a direction of the arrow. Then, the sub-pixel region $RA_6$ can be driven by the driving currents. Specifically, the sub-pixel region $RA_6$ includes partial sub-pixels of the pixel block $PB_2$ to the pixel block $PB_5$. The gate circuit $GC_E$ generates driving currents. The driving currents are transmitted to the sub-pixel region $RA_7$ along a direction of the arrow. Then, the sub-pixel region $RA_7$ can be driven by the driving currents. Specifically, the sub-pixel region $RA_7$ includes partial sub-pixels of the pixel block $PB_3$ and the pixel block $PB_4$. By doing so, all sub-pixels of the display panel 100 can be driven by using the gate circuit $GC_A$, the gate circuit $GC_B$, the gate circuit $GC_C$, the gate circuit $GC_D$, the gate circuit $GC_E$, and the gate circuit $GC_F$ in sequential. However, the driving method of the present invention is not limited to the driving method in FIG. 3. The direction of driving currents with respect to the gate circuit $GC_A$ to the gate circuit $GC_F$ in FIG. 3 can be also modified. For example, the driving currents of gate circuit $GC_F$ can be transmitted along an opposite direction in FIG. 3. Further, the gate circuit $GC_A$ to the gate circuit $GC_F$ can drive specific sub-pixel regions. For example, the gate circuit $GC_F$ can also drive the sub-pixel region $RA_6$. In other words, a single gate circuit can drive a plurality of sub-pixel regions. For a single sub-pixel region, driving currents can be inputted from a plurality of gate circuits. For example, the sub-pixel region $RA_4$ can be driven by using driving currents generated by the gate circuit $GC_D$ and the gate circuit $GC_C$.

Figure 4:
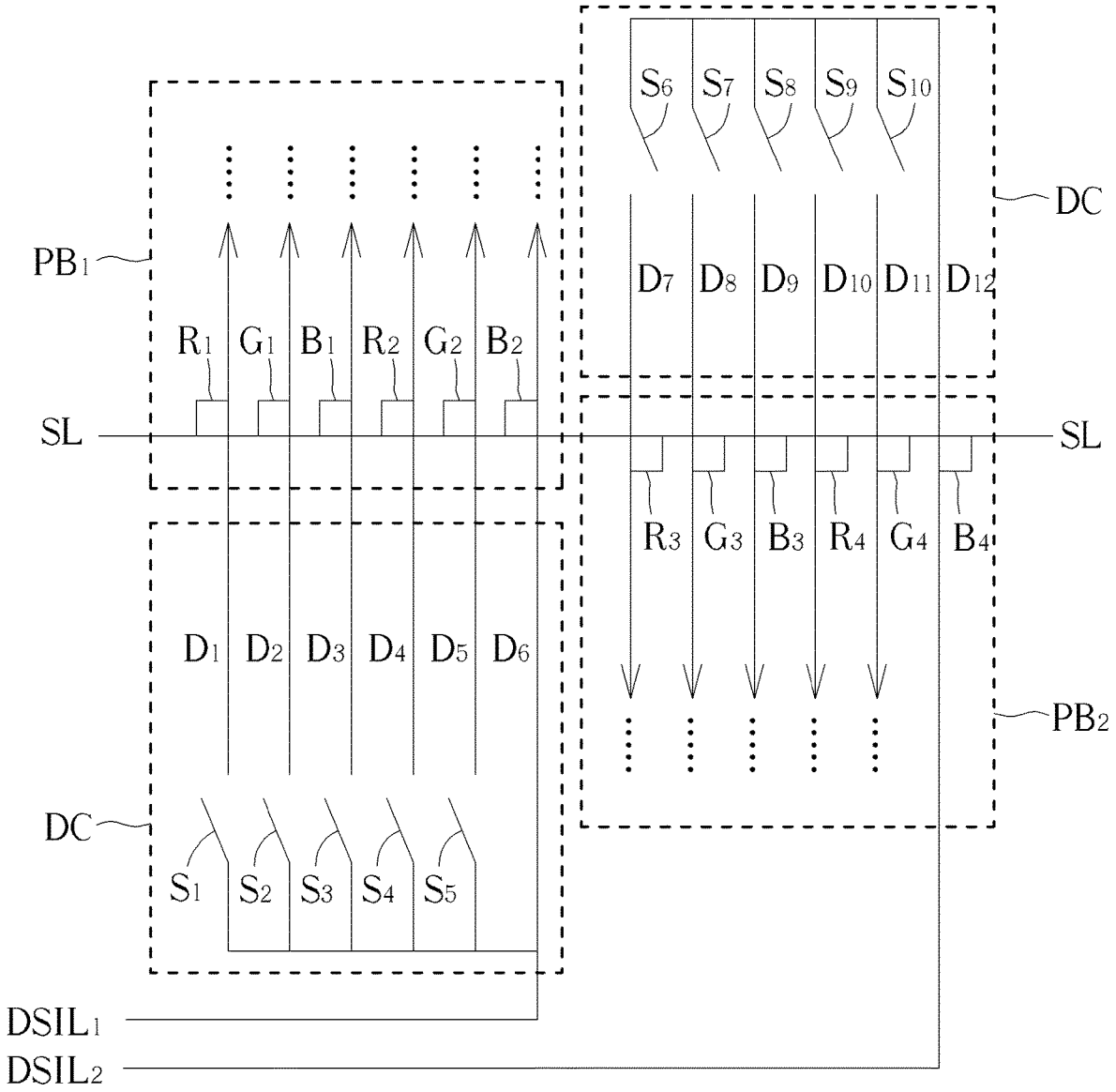
FIG. 4 illustrates a circuit structure of pixel blocks and data circuits of the display panel in FIG. 1.

FIG. 4 illustrates a circuit structure of pixel blocks $PB_1$ and $PB_2$ and the corresponding data circuits DC of the display panel 100. As shown in FIG. 4, the pixel blocks $PB_1$ includes a sub-pixel $R_1$, a sub-pixel $G_1$, a sub-pixel $B_1$, a sub-pixel $R_2$, a sub-pixel $G_2$, a sub-pixel $B_2$, and a scan line SL. These sub-pixels are respectively coupled to data lines $D_1$ to $D_6$. The pixel blocks $PB_2$ of the display panel 100 includes a sub-pixel $R_3$, a sub-pixel $G_3$, a sub-pixel $B_3$, a sub-pixel $R_4$, a sub-pixel $G_4$, a sub-pixel $B_4$, and a scan line SL. These sub-pixels are respectively coupled to data lines $D_7$ to $D_{12}$. In the display panel 100, a structure of pair-wised pixel blocks is similar to a structure of the pixel blocks $PB_1$ and $PB_2$. Further, the sub-pixels are allocated sequentially according to a pixel sequence formed by a red sub-pixel, a green sub-pixel, and a blue sub-pixel. For presentation brevity, two pixel blocks $PB_1$ and $PB_2$ are considered. Here, a data circuit DC disposed to the downside of the pixel block $PB_1$ can be a demultiplexer. The dimension of the demultiplexer in the embodiment is equal to six. The data circuit DC of the pixel block $PB_1$ includes a switch $S_1$, a switch $S_2$, a switch $S_3$, a switch $S_4$, and a switch $S_5$. The data circuit DC of the pixel block $PB_2$ includes a switch $S_6$, a switch $S_7$, a switch $S_8$, a switch $S_9$, and a switch $S_{10}$. A data source line $DSL_1$ is coupled to the data line $D_6$, wherein the data source line $DSL_1$ is also coupled to a data source DS (shown in FIG. 1). The data line $D_1$ to the data line $D_5$ of the pixel block $PB_1$ are respectively coupled to the data line $D_6$ through the switch $S_1$ to the switch $S_5$. Similarly, a data source line $DSL_2$ is coupled to the data line $D_{12}$, wherein the data source line $DSL_2$ is also coupled to a data source DS (shown in FIG. 1). The data line $D_7$ to the data line $D_{11}$ of the pixel block $PB_2$ are respectively coupled to the data line $D_{12}$ through the switch $S_6$ to the switch $S_{10}$. The method for driving sub-pixels (i.e., a row of sub-pixels) of the display panel 100 is illustrated below.

Here, an example is introduced to illustrate a process for driving the sub-pixel $R_1$, the sub-pixel $G_1$, the sub-pixel $B_1$, the sub-pixel $R_2$, the sub-pixel $G_2$, and the sub-pixel $B_2$ of the pixel block $PB_1$. Similarly, the sub-pixel $R_3$, the sub-pixel $G_3$, the sub-pixel $B_3$, the sub-pixel $R_4$, the sub-pixel $G_4$, and the sub-pixel $B_4$ of the pixel block $PB_2$ can be driven accordingly. The example is illustrated below. For the pixel block $PB_1$, a target voltage level of the sub-pixel $R_1$ is $V_{R1}$. A target voltage level of the sub-pixel $G_1$ is $V_{G1}$. A target voltage level of the sub-pixel $B_1$ is $V_{B1}$. A target voltage level of the sub-pixel $R_2$ is $V_{R2}$. A target voltage level of the sub-pixel $G_2$ is $V_{G2}$. A target voltage level of the sub-pixel $B_2$ is $V_{B2}$. First, the scan line SL is activated to enable the sub-pixel $R_1$ to the sub-pixel $B_2$. The switch $S_1$ to the switch $S_5$ of the data circuit DC corresponding to the pixel block $PB_1$ are disabled initially. Then, the data source DS generates the voltage level $V_{R1}$. The voltage level $V_{R1}$ is transmitted to the data line $D_6$ through the data source line $DSL_1$ during a first time interval $T_1$. In the moment, the switch $S_1$ is enabled. Thus, the voltage level $V_{R1}$ received by the data line $D_6$ can be also transmitted to the data line $D_1$. As a result, the sub-pixel $B_2$ and the sub-pixel $R_1$ can be respectively charged to reach the voltage level $V_{R1}$ through the data line $D_6$ and the data line $D_1$ during the first time interval $T_1$. After the first time interval $T_1$ is expired, the switch $S_1$ is disabled. In the following, the data source DS generates the voltage level $V_{G1}$. The voltage level $V_{G1}$ is transmitted to the data line $D_6$ through the data source line $DSL_1$ during a second time interval $T_2$. At the time, the switch $S_2$ is enabled. Thus, the voltage level $V_{G1}$ received by the data line $D_6$ can be also transmitted to the data line $D_2$. As a result, the sub-pixel $B_2$ and the sub-pixel $G_1$ can be respectively charged to reach the voltage level $V_{G1}$ through the data line $D_6$ and the data line $D_2$ during the second time interval $T_2$. After the second time interval $T_2$ is expired, the switch $S_2$ is disabled. In the following, the data source DS generates the voltage level $V_{B1}$. The voltage level $V_{B1}$ is transmitted to the data line $D_6$ through the data source line $DSL_1$ during a third time interval $T_3$. At the time, the switch $S_3$ is enabled. Thus, the voltage level $B_{B1}$ received by the data line $D_6$ can be also transmitted to the data line $D_3$. As a result, the sub-pixel $B_2$ and the sub-pixel $B_1$ can be respectively charged to reach the voltage level $V_{B1}$ through the data line $D_6$ and the data line $D_3$ during the third time interval $T_3$. After the third time interval $T_3$ is expired, the switch $S_3$ is disabled. In the following, the data source DS generates the voltage level $V_{R2}$. The voltage level $V_{R2}$ is transmitted to the data line $D_5$ through the data source line $DSL_1$ during a fourth time interval $T_4$. At the time, the switch $S_4$ is enabled. Thus, the voltage level $V_{R2}$ received by the data line $D_6$ can be also transmitted to the data line $D_4$. As a result, the sub-pixel $B_2$ and the sub-pixel $R_2$ can be respectively charged to reach the voltage level $V_{R2}$ through the data line $D_6$ and the data line $D_4$ during the fourth time interval $T_4$. After the fourth time interval $T_4$ is expired, the switch $S_4$ is disabled. In the following, the data source DS generates the voltage level $V_{G2}$. The voltage level $V_{G2}$ is transmitted to the data line $D_6$ through the data source line $DSL_1$ during a fifth time interval $T_5$. At the time, the switch $S_5$ is enabled. Thus, the voltage level $V_{G2}$ received by the data line $D_6$ can be also transmitted to the data line $D_5$. As a result, the sub-pixel $B_2$ and the sub-pixel $G_2$ can be respectively charged to reach the voltage level $V_{G2}$ through the data line $D_6$ and the data line $D_5$ during the fifth time interval $T_5$. After the fifth time interval $T_5$ is expired, the switch $S_5$ is disabled. In the following, the data source DS generates the voltage level $V_{B2}$. The voltage level $V_{B2}$ is transmitted to the data line $D_6$ through the data source line $DSL_1$ during a sixth time interval $T_6$. As a result, the sub-pixel $B_2$ can be charged to reach the voltage level $V_{B2}$ through the data line $D_6$ during the sixth time interval $T_6$. In the embodiment, the data source DS generates different voltage levels and transmits these voltage levels to the data line $D_6$ through the data source line $DSL_1$ during several time intervals. By doing so, the sub-pixel $R_1$, the sub-pixel $G_1$, the sub-pixel $B_1$, the sub-pixel $R_2$, the sub-pixel $G_2$, and the sub-pixel $B_2$ of the pixel block $PB_1$ can be respectively charged to the corresponding target voltage levels. The aforementioned driving process can be illustrated as the following table.

TABLE A

| | | | | | | Condition of charge | | | | | |
|---|---|---|---|---|---|---|---|---|---|---|---|
| | $S_1$ | $S_2$ | $S_3$ | $S_4$ | $S_5$ | $R_1$ | $G_1$ | $B_1$ | $R_2$ | $G_2$ | $B_2$ |
| $T_1$ | EN | DIS | DIS | DIS | DIS | $V_{R1}$ | | | | | $V_{R1}$ |
| $T_2$ | DIS | EN | DIS | DIS | DIS | $V_{R1}$ | $V_{G1}$ | | | | $V_{G1}$ |
| $T_3$ | DIS | DIS | EN | DIS | DIS | $V_{R1}$ | $V_{G1}$ | $V_{B1}$ | | | $V_{B1}$ |
| $T_4$ | DIS | DIS | DIS | EN | DIS | $V_{R1}$ | $V_{G1}$ | $V_{B1}$ | $V_{R2}$ | | $V_{R2}$ |
| $T_5$ | DIS | DIS | DIS | DIS | EN | $V_{R1}$ | $V_{G1}$ | $V_{B1}$ | $V_{R2}$ | $V_{G2}$ | $V_{G2}$ |
| $T_6$ | DIS | DIS | DIS | DIS | DIS | $V_{R1}$ | $V_{G1}$ | $V_{B1}$ | $V_{R2}$ | $V_{G2}$ | $V_{B2}$ |

In table A, the first row represents the switch $S_1$ to the switch $S_5$. The first column represents the time interval $T_1$ to the time interval $T_6$. The notation "EN" denotes the switch being enabled. The notation "DIS" denotes the switch being disabled. Obviously, six sub-pixels of the pixel block $PB_1$ can be respectively charged to reach the corresponding target voltage levels in a steady state. Specifically, the number of mischarges of the sub-pixel $B_2$ of the pixel block $PB_1$ is equal to 5. Although the mischarge status of the sub-pixel $B_2$ is occurred in a transient state, it can be ignored since time duration of the transient state is quite smaller than time duration of the steady state. In other words, the driving method of the pixel block $PB_1$ is that when several voltage levels (i.e., voltage level $V_{R1}$, voltage level $V_{G1}$, voltage level $V_{B1}$, voltage level $V_{R2}$, voltage level $V_{G2}$, and voltage level $V_{B2}$) are sequentially transmitted from the data source DS to the data line $D_6$ and the data line $D_1$ to the data line $D_5$, the switches (i.e., switch $S_1$, switch $S_2$, switch $S_3$, switch $S_4$, and switch $S_5$) are enabled and then disabled sequentially. Thus, when a corresponding voltage level is written to the sub-pixel $B_2$, the corresponding voltage level is written to at least one sub-pixel of the sub-pixel $R_1$, the sub-pixel $G_1$, the sub-pixel $B_1$, the sub-pixel $R_2$, and the sub-pixel $G_2$. Additionally, since the sub-pixel $B_2$ is pre-charged to reach the voltage level $V_{G2}$ through the data line $D_6$ during the fifth time interval $T_5$, only ($V_{B2}$-$V_{G2}$) voltage is required for charging the sub-pixel $B_2$ to reach the voltage level $V_{B2}$ during the sixth time interval $T_6$.

However, the method for driving the row of sub-pixels of the pixel block $PB_1$ is not limited to the method illustrated in table A. The method can be modified or changed to achieve a status that six sub-pixels of the pixel block $PB_1$ can be respectively charged to reach the corresponding target voltage levels (i.e., voltage level $V_{R1}$, voltage level $V_{G1}$, voltage level $V_{B1}$, voltage level $V_{R2}$, voltage level $V_{G2}$, and voltage level $V_{B2}$) in a steady state. The operation modes of the switch $S_1$ to the switch $S_5$ can also be changed. For example, in another embodiment, the switch $S_1$ to the switch $S_5$ can be enabled initially. The method for driving the row of sub-pixels of the pixel block $PB_1$ can be processed according to the following table.

TABLE B

| | | | | | | Condition of charge | | | | | |
|---|---|---|---|---|---|---|---|---|---|---|---|
| | $S_1$ | $S_2$ | $S_3$ | $S_4$ | $S_5$ | $R_1$ | $G_1$ | $B_1$ | $R_2$ | $G_2$ | $B_2$ |
| $T_1$ | EN | EN | EN | EN | EN | $V_{R1}$ | $V_{R1}$ | $V_{R1}$ | $V_{R1}$ | $V_{R1}$ | $V_{R1}$ |
| $T_2$ | DIS | EN | EN | EN | EN | $V_{R1}$ | $V_{G1}$ | $V_{G1}$ | $V_{G1}$ | $V_{G1}$ | $V_{G1}$ |
| $T_3$ | DIS | DIS | EN | EN | EN | $V_{R1}$ | $V_{G1}$ | $V_{B1}$ | $V_{B1}$ | $V_{B1}$ | $V_{B1}$ |
| $T_4$ | DIS | DIS | DIS | EN | EN | $V_{R1}$ | $V_{G1}$ | $V_{B1}$ | $V_{R2}$ | $V_{R2}$ | $V_{R2}$ |
| $T_5$ | DIS | DIS | DIS | DIS | EN | $V_{R1}$ | $V_{G1}$ | $V_{B1}$ | $V_{R2}$ | $V_{G2}$ | $V_{G2}$ |
| $T_6$ | DIS | DIS | DIS | DIS | DIS | $V_{R1}$ | $V_{G1}$ | $V_{B1}$ | $V_{R2}$ | $V_{G2}$ | $V_{B2}$ |

In table B, the switches (i.e., switch $S_1$, switch $S_2$, switch $S_3$, switch $S_4$, and switch $S_5$) are disabled sequentially. However, although six sub-pixels of the pixel block $PB_1$ can be respectively charged to reach the corresponding target voltage levels (i.e., voltage level $V_{R1}$, voltage level $V_{G1}$, voltage level $V_{B1}$, voltage level $V_{R2}$, voltage level $V_{G2}$, and voltage level $V_{B2}$) in a steady state, mischarge statuses of the sub-pixel $G_1$ to the sub-pixel $B_2$ are occurred in the transient state. Specifically, the number of mischarges of the sub-pixel $G_1$ is equal to one. The number of mischarges of the sub-pixel $B_1$ is equal to two. The number of mischarges of the sub-pixel $R_2$ is equal to three. The number of mischarges of the sub-pixel $G_2$ is equal to four. The number of mischarges of the sub-pixel $B_2$ is equal to five. Equivalently, the number of mischarges of all sub-pixels is equal to 15. The number of mischarges of all sub-pixels in table B is greater than the number of mischarges of all sub-pixels in table A. Thus, the method for driving the row of sub-pixels of the pixel block $PB_1$ by using the switches which are enabled and then disabled sequentially outperforms the method for driving the row of sub-pixels of the pixel block $PB_1$ by using the switches which are disabled sequentially.

The driving method of the pixel block $PB_2$ of the display panel 100 is similar to the driving method of the pixel block $PB_1$ of the display panel 100. For the pixel block $PB_1$, the driving currents are transmitted from the data source line $DSL_1$ to the corresponding sub-pixels through the data line $D_1$ to $D_6$ so that the corresponding sub-pixels can be charged to reach the target voltage levels respectively. For the pixel block $PB_2$ in FIG. 4, the driving currents generated from the data source DS are transmitted to the data line $D_{12}$ through the data source line $DSL_2$ for charging a sub-pixel $B_4$ to reach a target voltage level. Similarly, the switches $S_6$ to $S_{10}$ can be enabled and then disabled sequentially, or can be selectively disabled sequentially. By doing so, a target voltage level can be inputted to a corresponding sub-pixel (i.e., a corresponding sub-pixel selected from the sub-pixel $R_3$ to the sub-pixel $G_4$) through a corresponding switch. Since the driving method of the pixel block $PB_2$ is similar to the driving method of the pixel block $PB_1$, the illustration is omitted here. Particularly, in the pixel block $PB_2$, since the data line $D_{12}$ can be regarded as an embedded connection line for transmitting data signal from the data source DS to the pixel block $PB_2$, a quantity of connection lines in the fan-out circuit can be reduced, leading to optimize the allocation of the data circuit DC and the fan-out circuit. Further, since a structure of each pixel block of the rest pixel blocks in the display panel 100 is similar to the structure of the pixel block $PB_1$ or $PB_2$ shown in FIG. 4, the layout area requirement of the display panel 100 can be further reduced, leading to optimize the border width of the display panel 100.

Figure 5:
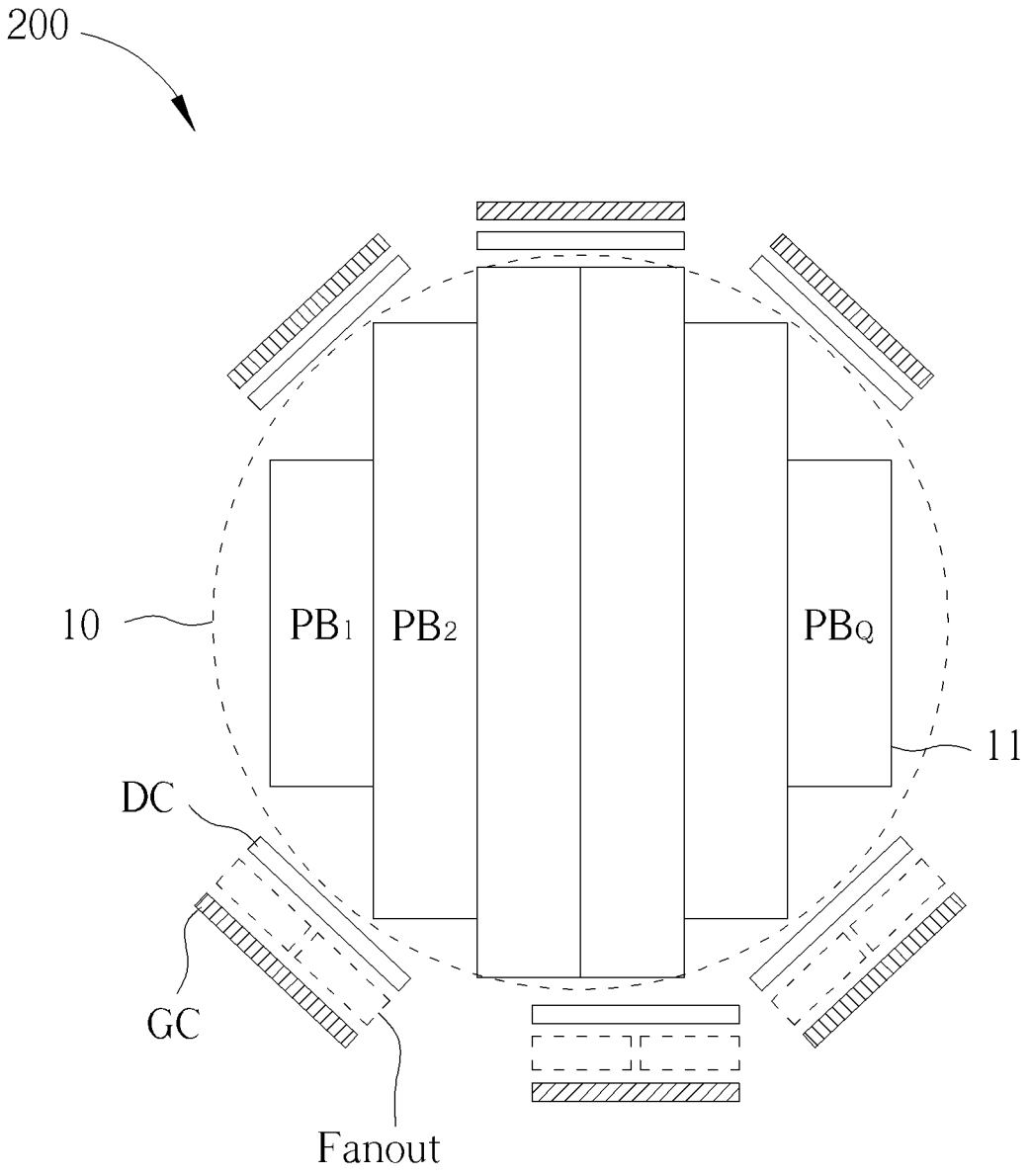
FIG. 5 illustrates a structure of a display panel according to a second embodiment of the present invention.

FIG. 5 illustrates a structure of a display panel 200 according to a second embodiment of the present invention. As shown in FIG. 5, pair-wised gate circuit GC and data circuit DC are disposed to a side of two pixel blocks of the display panel 200. Another pair-wised gate circuit GC and data circuit DC is disposed to another side of the two pixel blocks of the display panel 200. Specifically, a fan-out circuit can be disposed between the gate circuit GC and the data circuit DC. In the display panel 200, the data circuit DC disposed to the downside of the pixel block $PB_1$ and the pixel block $PB_2$ can be used for driving the pixel block $PB_1$. The data circuit DC disposed to the upside of the pixel block $PB_1$ and the pixel block $PB_2$ can be used for driving the pixel block $PB_2$. As a result, a thickness of the data circuit DC can be further reduced. For example, in the display panel 100, a width of the data circuit DC is smaller than or equal to a width of the pixel block. In the display panel 200, a width of the data circuit is 1-2 times greater than a width of the pixel block. However, a thickness of the data circuit DC of the display panel 200 is quite smaller (i.e., around ⅕) than a thickness of the data circuit DC of the display panel 100. Thus, a layout area requirement of the data circuit DC of the display panel 200 is smaller than a layout area requirement of the data circuit DC of the display panel 100. Thus, a width of border of the display panel 200 can be further reduced.

Although the display panel 100 and display panel 200 are circular display panels, the present invention is not limited to the circular display panels. For example, in other embodiments, the display panel can be a rectangular shaped display panel, a triangular shaped display panel, or any arc shaped display panel. The display panel 100 and 200 uses the demultiplexer with 6 dimensions. However, the present invention is not limited to use the demultiplexer with 6 dimensions. In other embodiments, any demultiplexer with at least 2 dimensions can be applied to the display panel. Further, the row of sub-pixels of the display panel 100 and 200 are allocated sequentially according to a pixel sequence formed by a red sub-pixel, a green sub-pixel, and a blue sub-pixel. However, the row of sub-pixels of the present invention is not limited to use the fixed pixel sequence. In other embodiments, each pixel block can include a subset of three primary color sub-pixels. For example, a first pixel block can include a red sub-pixel R and a green sub-pixel G. A second pixel block can include a blue sub-pixel B and a red sub-pixel R. A third pixel block can include a green sub-pixel G and a blue sub-pixel B.

To sum up, the present invention discloses a display panel with a slim border. Some data lines of pixel blocks can be regarded as some embedded connection lines for transmitting data signal. The method for driving display panel is also disclosed. The idea is to charge at least two sub-pixels to reach a voltage level generated by a data source simultaneously. Since a quantity of connection lines in the fan-out circuit can be reduced, allocations of the data circuit DC and the fan-out circuit can be optimized. Thus, a width or layout area requirement of the display panel border can be further reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display panel, comprising:

a pixel block, comprising:

a first sub-pixel coupled to a first data line; and

N second sub-pixels, each second sub-pixel of the N second sub-pixels coupled to a corresponding second data line of N second data lines;

a data circuit, comprising:

N switches, each switch of the N switches coupled to a corresponding second data line for reaching a corresponding second sub-pixel, wherein N is a positive integer; and a data source coupled to the first data line and the N switches;

wherein N voltage levels are outputted from the data source to the first sub-pixel via the first data line; and wherein each of the N switches is enabled in sequence for forwarding a corresponding one of N voltage levels to the corresponding second sub-pixel via the corresponding second data line;

wherein each of N voltage levels passes through the first sub-pixel before reaching each of N switches.

2. The display panel of claim 1, wherein when the N voltage levels are sequentially outputted from the data source to the first data line and the N second data lines, the N switches are enabled and then disabled sequentially.

3. The display panel of claim 1, wherein two data circuits respectively coupled to two adjoining pixel blocks are disposed to different sides of the two adjoining pixel blocks.

4. The display panel of claim 1, wherein the N second sub-pixels and the first sub-pixel are allocated sequentially according to a pixel sequence formed by a red sub-pixel, a green sub-pixel, and a blue sub-pixel.

5. The display panel of claim 1, further comprising:

a gate circuit for driving a plurality of sub-pixels of at least one pixel block;

wherein the gate circuit and the data circuit are disposed to two opposite sides of the pixel block.

6. The display panel of claim 1, wherein widths of a plurality of pixel blocks of the display panel are identical.

7. The display panel of claim 1, wherein a width of the data circuit is smaller than or equal to a width of the pixel block.

8. The display panel of claim 1, wherein a width of the data circuit is 1-2 times greater than a width of the pixel block.

9. The display panel of claim 1, wherein widths of a plurality of pixel blocks of the display panel are not all the same.

10. The display panel of claim 1, wherein the data circuit is a demultiplexer.

11. The display panel of claim 1, wherein the first sub-pixel is blue.

12. The display panel of claim 1, further comprising:

a gate circuit for driving a plurality of sub-pixels of at least one pixel block; and a fan-out circuit, wherein the fan-out circuit is disposed between the data circuit and the gate circuit;

wherein the plurality of sub-pixels form a display area, the data circuit is disposed adjacent to a perimeter of the display area, and the gate circuit is further away from the perimeter of the display area.

13. The display panel of claim 1, wherein the first data line connects the data source to each of N switches.

14. The display panel of claim 1, wherein the data circuit is a demultiplexer.

15. A display panel, comprising:

a pixel block, comprising:

a first sub-pixel coupled to a first data line; and

N second sub-pixels, each second sub-pixel of the N second sub-pixels coupled to a corresponding second data line of N second data lines;

a data circuit, comprising:

N switches, each switch of the N switches coupled to a corresponding second data line for reaching a corresponding second sub-pixel; and a data source coupled to the first data line and the N switches;

wherein N voltage levels are outputted from the data source to the first sub-pixel via the first data line, each of the N switches is enabled initially, and each of the N switches is disabled in sequence after forwarding a corresponding one of N voltage levels to the first data line and N data line, and N is a positive integer;

wherein each of N voltage levels passes through the first sub-pixel before reaching each of N switches.

16. The display panel of claim 15, wherein two data circuits respectively coupled to two adjoining pixel blocks are disposed to different sides of the two adjoining pixel blocks.

17. The display panel of claim 15, wherein the N second sub-pixels and the first sub-pixel are allocated sequentially according to a pixel sequence formed by a red sub-pixel, a green sub-pixel, and a blue sub-pixel.

18. The display panel of claim 15, wherein widths of a plurality of pixel blocks of the display panel are identical.

19. The display panel of claim 15, wherein a width of the data circuit is smaller than or equal to a width of the pixel block.

* * * * *